United States Patent [19]

Pitts

[11] Patent Number: 4,739,541

[45] Date of Patent: Apr. 26, 1988

[54] CLIPBOARD MOUNTED RETAINER FOR WRITING INSTRUMENTS AND THE LIKE

[75] Inventor: Warren R. Pitts, Needham, Mass.

[73] Assignee: Dennison Manufacturing Company, Framingham, Mass.

[21] Appl. No.: 55,403

[22] Filed: May 29, 1987

[51] Int. Cl.[4] ..... B42F 1/00

[52] U.S. Cl. ..... 24/67.7; 24/67.3; 24/67.11

[58] Field of Search ..... 24/67 R, 67.7, 67.9, 24/67.11, 67.3, 67.5, 546, 545; 40/10 R; 108/43; 281/15 B, 45

[56] References Cited

U.S. PATENT DOCUMENTS

| | | | |
|---|---|---|---|
| 256,138 | 4/1882 | Graham | 24/67.3 |
| 1,011,707 | 12/1911 | Ankeny | 281/15 B |
| 1,057,156 | 3/1913 | Lawnin | 24/17 AP |
| 1,405,024 | 1/1922 | Smith et al. | 24/67.11 |
| 2,701,173 | 2/1955 | Senior et al. | 24/67.3 |
| 2,783,062 | 2/1957 | Helberg | 24/67.5 |
| 2,876,022 | 3/1959 | Kroviak | 24/67.7 |
| 3,105,279 | 10/1963 | Westhoff | 24/67.7 |
| 3,828,402 | 8/1974 | Gorman | 24/67.7 |
| 4,569,108 | 2/1986 | Schwab | 24/17 AP |

*Primary Examiner*—Victor N. Sakran

*Attorney, Agent, or Firm*—George E. Kersey

[57] ABSTRACT

Retainer for convenient storage of writing implements or the like upon a clipboard having a movable clip member with an upper circular catch member aperture, and an elongated lower edge portion; an elastic band member for retaining the implements against the clip member, having an upper hook grasping the upper apreture, and a lower hook for grasping a lower edge portion of the movable clip member.

10 Claims, 1 Drawing Sheet

CLIPBOARD MOUNTED RETAINER FOR WRITING INSTRUMENTS AND THE LIKE

BACKGROUND OF THE INVENTION

The present invention relates to the field of clipboards for mounting pads of paper thereon.

Clipboards are widely utilized to support pads of paper for recording data thereon and are particularly useful in athletic and other outdoor environments. The person utilizing a clipboard occasionally misplaces writing implements to be used in connection with the clipboard, and it is thus highly desirable to provide a simple and inexpensive retainer which may be utilized for the convenient storage of writing implements, pen-lights or the like, upon a clipboard having a conventional movable spring loaded clip member.

SUMMARY OF THE INVENTION

A retainer for convenient storage of writing implements or the like upon a clipboard utilizing an elastic band member having a first coupling hook adapted to engage the upper aperture of the movable clip, and a second coupling hook adapted to engage a lower portion of the movable clip. In one embodiment the second hook is positioned within a notch in an edge portion of the clip, and in a second embodiment the hook is U-shaped and is positioned about the lower edge of the clip along its length.

Other objects, features and advantages of the invention will become apparent upon study of the following detailed description, taken in conjunction with the drawings in which.

DETAILED DESCRIPTION

Figure 1:
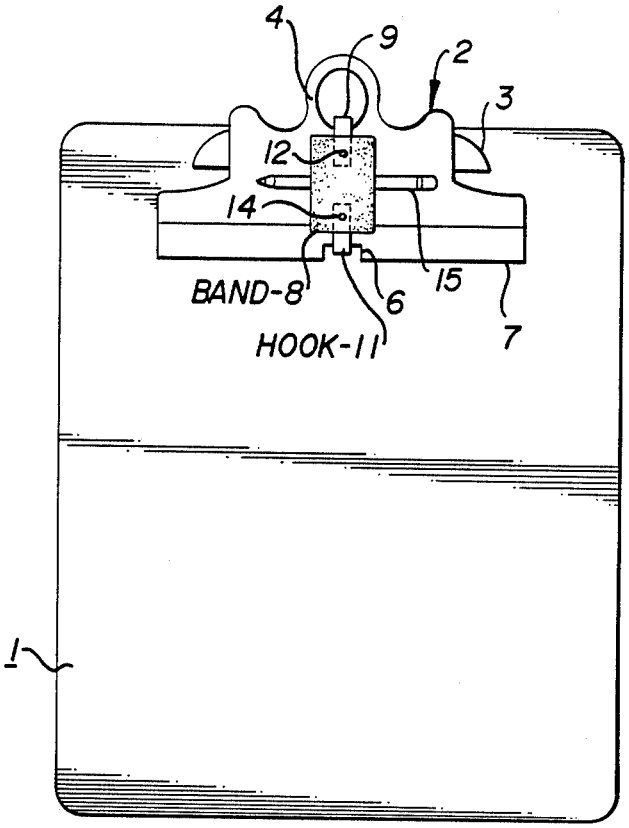
FIGS. 1 and 2 illustrate a first embodiment of the invention.
Figure 2:
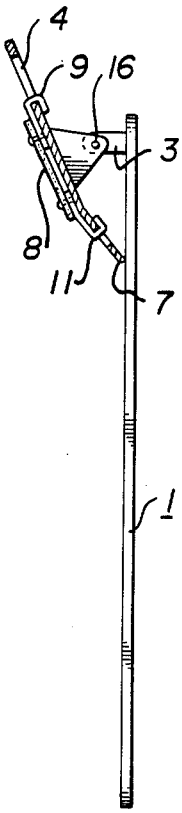

In FIGS. 1 and 2, a rigid clipboard backing member or backboard 1, has a non-movable clip member 3 affixed to backboard 1, which supports a movable clip member 2 having an upper catch member aperture 4 and an elongated lower edge portion 7, for pressing against the backboard to secure sheets of paper thereon. The movable upper clip member 2 is pivoted to the lower stationary clip member 3 via pivot 16 illustrated in FIG. 2. The upper clip member is conventional, except for a notch 6 formed within lower portion 7 of the clip member. An elastic band 8 is provided, having a first coupling member, preferably in the form of a hook 9, affixed to one end of the band by a rivet 12, and a second hook member 11 affixed to the opposite end of band 8 via rivet 14. Hook member 9 is adapted to grip the periphery of the conventional upper circular aperture 4, whereas hook 11 is adapted to grip notch 6 within the lower edge portion of clip 2 as illustrated in FIG. 1. The length of elastic band 8 is designed so that the band will be stretched when hooks 9 and 11 are seated within catch member apertures 4 and 6. Pencil 15 may then be readily slipped between the lower surface of band 8, and the upper surface of movable clip member 2. Pen lights, rulers and similar instruments can also be conveniently stored upon the upper clip member, and will be maintained in position by the elasticity of band 8.

If notch 6 was absent, the relatively narrow hook member 11 would be positioned about the lower edge portion 7 of the clip member, which could function as a catch member for the hook. Since the spring force for maintaining the lower edge portion 7 against the pad of paper is considerable, the amount of pressure exerted by the lower edge of hook 11 would be very high, owing to its small area, and such an unduly high pressure could make an undesirable indentation within the paper, and would prevent the major length of the lower edge portion 7 from contacting the sheets to distribute the spring force and thus lower the pressure. Should a base member having a pressure sensitive adhesive thereon, together with a catch or hook member complementary to hook 11 be provided, such a member might be affixed to the lower edge portion 7 of the clamp, thereby to eliminate the need for a notch 6 and to thus enable the device to be sold for use in connection with completely conventional clipboards.

Figure 3:
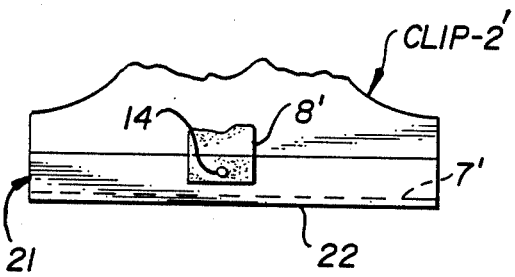
FIGS. 3 and 4 illustrate a second embodiment of the invention, which requires no modification of a conventional spring loaded clipboard clamp.
Figure 4:
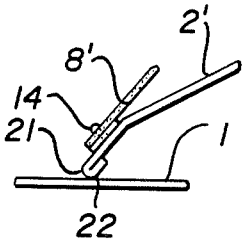

FIGS. 3 and 4 illustrate a second embodiment of the invention which may be marketed for use in connection with completely conventional clipboards; that is those which do not have notch 6 formed therein. The lower portion of band 8' is affixed to an upper portion of elongated hook member 21, which in contrast with hook 11, extends across a substantial portion of the backboard to cover most or all of lower portion 7' of movable clip member 2'. In FIG. 4, it may be seen that the lower edge of extended hook member 21 passes completely around the lower edge 7' of the conventional movable clip member. The preferred configuration of elongated hook 21 is U-shaped, so that it "wraps around" edge 7' as indicated in FIG. 4. The lower portion of extended hook 21 is indicated at 22, which presses against the upper surface of the rigid clipboard backing 1. The radius of curvature of the U-shaped member is great enough to prevent creasing of the paper positioned upon the backboard. Since hook member 21 extends across a substantial width of backboard 1, the pressure asserted upon particular portions of the sheet will be relatively small, since the spring force of the clip is applied across a wide area of the sheet upon the backboard. Upper portions of the band 8' of FIGS. 3 and 4 have not been shown, since they correspond to upper portions of band 8 of FIGS. 1 and 2. Likewise the upper portions of the movable clip member 2' have not been shown as they are identical with the portions of member 2 shown in FIGS. 1 and 2. Thus the elongated elastic member having hook 9 thereon, takes advantage of the presence of the conventional upper circular aperture 4 in standard clipboards, utilized to enable the clipboard to be mounted upon a nail or the like.

Since numerous variations may be made within the scope of the invention, it is to be understood that the scope of the invention is to be restricted only by the terms of the following claims and art recognized equivalents thereof.

What is claimed is:

1. A retainer for convenient storage of writing implements or the like upon a clipboard having a flat rigid back, a movable clip with an upper catch aperture therein and an elongated edge portion, said retainer comprising:

an elastic band having a first non-centralized portion with a first coupling member composing a first hook attached thereto, adapted to engage said upper aperture, and a second coupling member comprising a second hook attached to a second non-centralized portion of said elastic member, remote from said first non-centralized portion and adapted to engage the elongated edge portion of said movable clip member;

said second hook being elongated and extending across a substantial portion of said back and over a lower edge of said movable clip member with a radius of curvature great enough to prevent creasing of paper positioned upon said back and gripped by said second hook.

2. The retainer of claim 1 wherein said second hook member is positioned within a lower catch member formed within a lower edge portion of said upper clip member, positioned to prevent said second hook member from pressing against said backboard.

3. The retainer of claim 1 wherein said second hook member has a U-shaped cross section.

4. The retainer of claim 2 wherein said lower catch member comprises a second catch member aperture formed within said upper clip member remote from said upper catch member aperture.

5. The combination as setforth in claim 4 wherein said second catch member aperture is a narrow notch formed within said lower edge portion of said movable clip member.

6. A retainer for convenient storage of writing implements or the like upon a clipboard having a flat rigid back, a movable clip having upper and lower portions and an elongated edge, said retainer comprising:

an elastic band having a first non-centralized portion with a first coupling member composing a first hook attached thereto, adapted to engage said upper aperture, and a second coupling member comprising a second hook attached to a second non-centralized portion of said elastic member, remote from said first non-centralized portion and adapted to engage the elongated edge portion of said movable clip member;

said second hook being elongated and extending across a substantial portion of said back and over a lower edge of said movable clip member with a radius of curvature great enough to prevent creasing of paper positioned upon said back and gripped by said second hook.

7. The retainer of claim 6 wherein said second hook member is positioned within a lower catch member formed within a lower edge portion of said clip member, positioned to prevent said second hook member from pressing against said backboard.

8. The retainer of claim 6 wherein said second hook member has a U-shaped cross section.

9. The retainer of claim 6 wherein said lower catch member comprises a second catch member aperture formed within said clip member.

10. The combination as setforth in claim 6 wherein said second catch member aperture is a narrow notch formed within said lower edge portion of said movable clip member.

* * * * *